US008944073B1

(12) United States Patent
Sinclair, Jr.

(10) Patent No.: US 8,944,073 B1
(45) **Date of Patent: *Feb. 3, 2015**

(54) METHOD AND APPARATUS FOR PREPARING A FINISHED TOBACCO PRODUCT INCLUDING AN ATTACHED OUTER PRE-ROLLED SHEET AND INNER SHELL

(75) Inventor: Daniel S. Sinclair, Jr., Mandeville, LA (US)

(73) Assignee: Blunt Wrap U.S.A., Inc., Mandeville, LA (US)

( * ) Notice: Subject to any disclaimer, the term of this patent is extended or adjusted under 35 U.S.C. 154(b) by 144 days.

This patent is subject to a terminal disclaimer.

(21) Appl. No.: 13/454,164

(22) Filed: Apr. 24, 2012

Related U.S. Application Data

(63) Continuation of application No. 12/370,895, filed on Feb. 13, 2009, now Pat. No. 8,161,979.

(60) Provisional application No. 61/028,434, filed on Feb. 13, 2008.

(51) Int. Cl.
*A24C 5/35* (2006.01)

(52) U.S. Cl.
USPC ..... 131/283; 131/360; 131/365; 131/281; 131/374; 131/280

(58) Field of Classification Search
None
See application file for complete search history.

(56) References Cited

U.S. PATENT DOCUMENTS 5,462,073 A * 10/1995 Bowen et al. ..... 131/374
2006/0000481 A1* 1/2006 Sinclair ..... 131/347

* cited by examiner

*Primary Examiner* — Richard Crispino
*Assistant Examiner* — Phu Nguyen
(74) *Attorney, Agent, or Firm* — Brett A. North; Garvey, Smith, Nehrbass & North, LLC.

(57) ABSTRACT

A finished tobacco product is formed by an inner shell and attached outer pre-rolled sheet where the inner shell has a means to open an interior volume to add selected tobacco filler material.

21 Claims, 11 Drawing Sheets

FIG. 20A
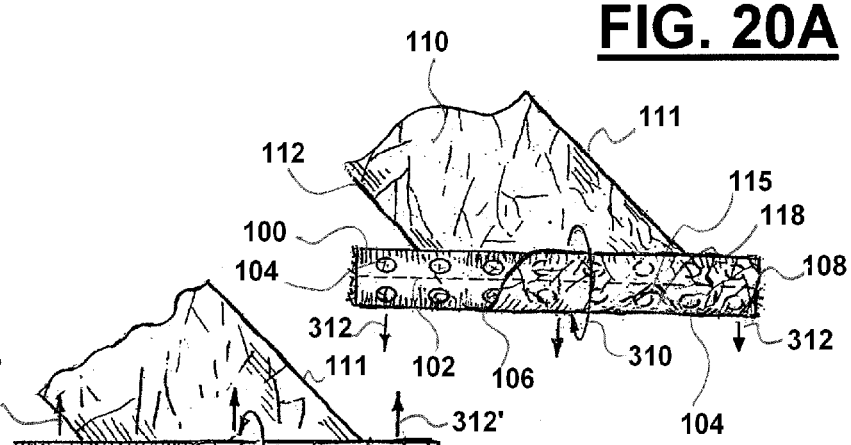
FIG. 20C
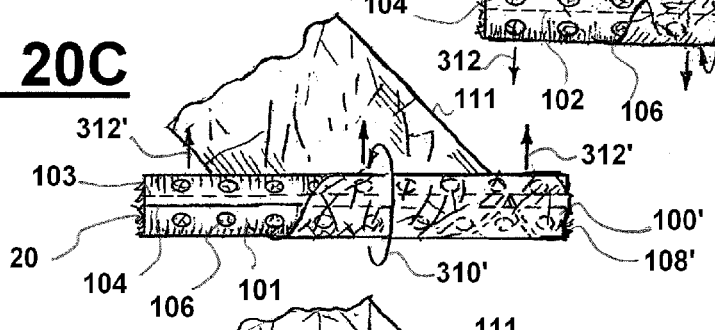
FIG. 20B
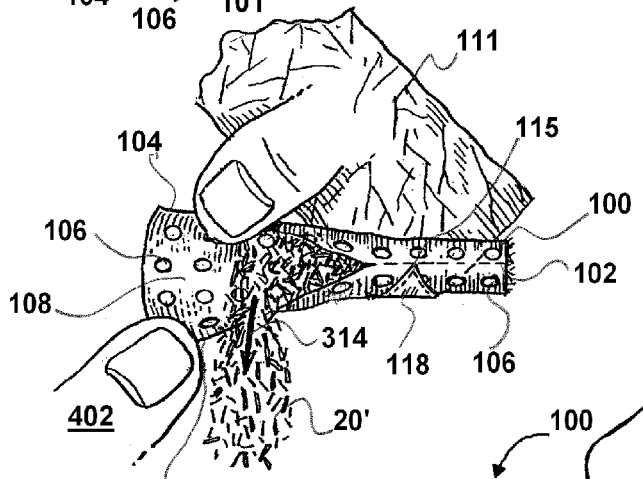
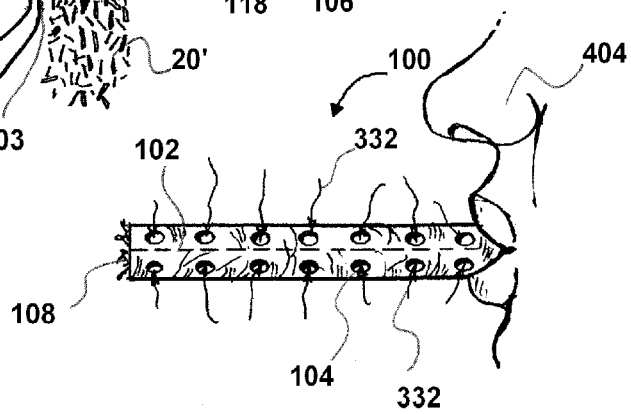
FIG. 20D

METHOD AND APPARATUS FOR PREPARING A FINISHED TOBACCO PRODUCT INCLUDING AN ATTACHED OUTER PRE-ROLLED SHEET AND INNER SHELL

CROSS-REFERENCE TO RELATED APPLICATIONS

This is a continuation of U.S. patent application Ser. No. 12/370,895, filed Feb. 13, 2009 (issuing as U.S. Pat. No. 8,161,979 on Apr. 24, 2012), which application was a non-provisional of U.S. Provisional Patent Application Ser. No. 61/028,434, filed Feb. 13, 2008.

Each of these applications are incorporated herein by reference. Priority of each of these applications is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND

On embodiment relates to tobacco products, and more particularly to a tobacco kit product enabling an end user or consumer to prepare a custom tobacco product. The variety, quality and size of ready-made cigars and/or cigarettes satisfy the majority of the public. However, a small segment of connoisseurs insist that nothing can compare with the taste and smell of custom-blended tobacco products. These knowledgeable individuals are very selective in the manner their tobacco products are rolled and in the grade of tobacco used. A still smaller segment of aficionados prefers to roll their own tobacco products. They buy tobacco leaves or cigar wrappings and use their preferred brand of crushed tobacco. Some people buy inexpensive cigars, cut them with a sharp blade along the side, and carefully pry the cut cigar open. The innermost layers are then removed and substituted with a favorite brand of crushed tobacco, which may come from cigarettes or bulk tobacco blend. The user then brings the cut edges of the cigar together, closing the outer layers of the cigar over the "stuffing." The edges are then sealed with a liquid or honey, and a new cigar is ready for smoking.

Some reports indicate that the roll-your-own tobacco market is flourishing. In some countries, the roll-your-own products now hold a substantial share of the tobacco market, and their consumers represent more than 10% of the smoking population. This may be explained by the ability of a consumer to create a tailor-made product, as opposed to commercially available types of tobacco products.

A disadvantage of the existing method of making such custom-made tobacco product is that a consumer has to be skillful in the rolling of tobacco products, that is to have a certain finger dexterity, which would allow him to make a tobacco product shell without crushing the item being used to make the tobacco product. Inexperienced people often become frustrated when the finished product collapses because the tobacco product was not properly rolled.

In the prior art there are various items which assist consumers in making customized cigars. For example, in U.S. Pat. No. 6,742,525 discloses a "tobacco product . . . formed by rolling a sheet of material supplied by a roll or rolls (e.g. moistened tobacco leaves) and/or homogenized sheet tobacco about a slit mandrel to form a shaped tube. The shaped tube is then packaged for shipment to an end user or consumer. The shaped tube remains in the rolled, shaped tube form inside the package. After the shaped tube is removed from the package, a consumer can fill the tube with crushed tobacco leaves or other tobacco filler material of a favorite blend, thereby eliminating some steps in the making of a "roll-your-own" tobacco product." ('525 patent: Abstract).

As another example, United States printed publication number US 2006/0000481 discloses a cigar with perforations allowing the cigar to be easily opened by a user who wishes to replace the original tobacco filler material with a custom tobacco filler material. ('481 Publication: paragraph 0044).

However, even though such prior art systems provide systems assisting individuals with limited finger dexterity in making custom made tobacco products, some amount of finger dexterity is still required at least when starting the rolling process. Additionally, these prior art systems tend to require the user to seal the rolled tobacco product along the longitudinal length of the tobacco product to stop the product.

Furthermore, the perforated cigar disclosed in the '481 Publication has the disadvantage that the perforations can open before use causing tobacco filler material to be released and/or creating air flow openings in various positions about the longitudinal length which can short circuit air flow during smoking.

It would be advantageous to provide a tobacco product which avoids the disadvantages of the prior art.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

In one embodiment is provided an inner shell or tube having an outer wall with inner volume, along with an outer pre-rolled sheet attached to the inner shell, the outer wall of the inner shell having a rolling memory, wherein the outer pre-rolled sheet can be unrolled to expose the inner shell, and the outer wall of the inner shell includes a means for forming edges which can be moved apart to open, enlarge, and/or expose the inner volume, and allow placement of a selected tobacco filler in the inner volume, wherein subsequently the rolling memory of the outer wall of the inner shell can be used to move the edges closer together and at least partially close the inner volume, and then the inner shell and outer pre-rolled sheet can together be rolled to form a finished custom made tobacco product.

In one embodiment the inner shell is a finished cigar or cigarette.

In one embodiment the inner shell is filled with tobacco filler.

In one embodiment the outer wall of the inner shell includes binder and wrapper layers.

In one embodiment the outer wall of the inner shell includes plurality of material layers.

In one embodiment the outer wall of the inner shell is comprised of homogenized tobacco paper.

In one embodiment the outer wall of the inner shell is comprised of natural leaves.

In one embodiment the outer wall of the inner shell is comprised of smokable materials.

In various embodiments the outer wall of the inner shell is comprised of smokable materials chosen from any combination of the following materials: natural leaf, homogenized tobacco paper, pipe tobacco, different types of flavored tobacco, cellulose (clear, opaque, or colored), paper, tea leaves, kanna, blue lotus, *salvia, salvia eivinorm*, wild dagga, kratom, herbal non-tobacco, Celandine Poppy, Mugwort, Purple Lavender Flowers, Coltsfoot Leaf, Ginger root, California Poppy, *Sinicuichi*, St. John's Wort, *Capillarius* herba, Yerba Lenna Yesca, *Calea Zacatechichi, Leonurus Sibericus* Flowers, Wild Dagga Flowers, Klip Dagga Leaf, Damiana, Hookah, *Hemia salicifolia*, Kava Kava, *Avena Sativa*, scotch broom topps, Valarian, *capillarius*, herba, Wild clip dagga, *Leonurus sibiricus*, Kama, *Sinicuichi*, and/or *lactuca virosa.*

In one embodiment the outer pre-rolled sheet includes binder and wrapper layers.

In one embodiment the outer pre-rolled sheet includes plurality of material layers.

In one embodiment the outer pre-rolled sheet is comprised of homogenized tobacco paper.

In one embodiment the outer pre-rolled sheet is comprised of natural leaves.

In one embodiment the outer pre-rolled sheet is comprised of smokable materials.

In various embodiments the outer pre-rolled sheet is comprised of smokable materials chosen from any combination of the following materials: natural leaf, homogenized tobacco paper, pipe tobacco, different types of flavored tobacco, cellulose (clear, opaque, or colored), paper, tea leaves, kanna, blue lotus, *salvia, salvia eivinorm*, wild dagga, kratom, herbal non-tobacco, Celandine Poppy, Mugwort, Purple Lavender Flowers, Coltsfoot Leaf, Ginger root, California Poppy, *Sinicuichi*, St. John's Wort, *Capillarius* herba, Yerba Lenna Yesca, *Calea Zacatechichi, Leonurus Sibericus* Flowers, Wild Dagga Flowers, Klip Dagga Leaf, Damiana, Hookah, *Hemia salicifolia*, Kava Kava, *Avena Sativa*, scotch broom topps, Valarian, *capillarius*, herba, Wild clip dagga, *Leonurus sibiricus*, Kanna, *Sinicuichi*, and/or *lactuca virosa.*

In various embodiments the outer pre-rolled sheet is affixed to the outer wall of the inner shell, such as by adhesives or other means to affix.

In various embodiments the inner volume of the inner shell is filled with various types of filler and/or blending between the types of filler included. In one embodiment different types of filler material can be chosen from any combination of the following types of filler material: smoking tobacco, pipe tobacco, different types of flavored tobacco, tea leaves, kanna, blue lotus, *salvia, salvia eivinorm*, wild dagga, kratom, herbal non-tobacco, Celandine Poppy, Mugwort, Purple Lavender Flowers, Coltsfoot Leaf, Ginger root, California Poppy, *Sinicuichi*, St. John's Wort, *Capillarius* herba, Yerba Lenna Yesca, *Calea Zacatechichi, Leonurus Sibericus* Flowers, Wild Dagga Flowers, Klip Dagga Leaf, Damiana, Hookah, *Hemia salicifolia*, Kava Kava, *Avena Sativa*, scotch broom topps, Valarian, *capillarius*, herba, Wild clip dagga, *Leonurus sibiricus*, Kanna, *Sinicuichi*, and/or *lactuca virosa.*

In one embodiment is included a means in the outer wall of the inner shell for forming edges which can be moved apart to open, enlarge, and/or expose the inner volume which means is a longitudinal perforation line.

In one embodiment the means in the outer wall of the inner shell for forming edges which can be moved apart to open, enlarge, and/or expose the inner volume is an irregularly shaped longitudinal perforation line. In one embodiment the irregularly shaped line is serrated.

In one embodiment the means in the outer wall of the inner shell for forming edges which can be moved apart to open, enlarge, and/or expose the inner volume is a spirally shaped longitudinal perforation line along the longitudinal axis of the inner shell.

In various of the embodiments the means of the outer wall of the inner shell for forming edges which can be moved apart to open, enlarge, and/or expose the inner volume is an etched line.

In various of the embodiments the means of the outer wall of the inner shell for forming edges which can be moved apart to open, enlarge, and/or expose the inner volume is a stitching between the edges of the inner shell.

In various embodiments the inner shell serves as a mandrel/form casing being sufficiently rigid or flexible material in a form of a cylinder of a predetermined length and outer diameter.

In various embodiments a separate mandrel/form casing relative to the inner shell can be used, which separate mandrel/form casing can be made either hollow, with a central opening, or as a solid body. It is desirable that this mandrel/form casing 170 be substantially inflexible and strong enough to withstand forces applied to mandrel/form casing when inner shell and outer pre-rolled tobacco sheet are rolled along with when such are unrolled.

One embodiment provides an inner shell and outer pre-rolled sheet for fabricating and making custom a made tobacco product, and a method of making such custom tobacco product.

One embodiment provides various configurations of additional pre-rolled sheets beyond the outer pre-rolled sheet. One embodiment includes a layered configuration of pre-rolled sheets including a first sheet of homogenized tobacco paper, a second sheet of natural leaf, and a third sheet of homogenized tobacco paper. One embodiment includes a layered configuration of pre-rolled sheets including a first sheet of natural leaf, a second sheet of homogenized tobacco paper, and a third sheet of natural leaf. One embodiment includes a plurality of additional pre-rolled sheets numbering 2, 3, 4, 5, 6, 7, 8, 9, 10, 11, 12, 13, 14, 15, 16, 17, 18, 19, 20, 21, 22, 23, 24, 25, 26, 27, 28, 29, or 30. Various embodiments include possible ranges between any of the combinations of the above listed numbers. For example, between 3 and 20, 5 and 15, etc.

One embodiment additional pre-rolled includes sheets made of the same material, such as homogenized tobacco paper, natural leaf, rolling paper, and/or sheets of other smokable materials. One embodiment includes possible combinations of the different types of sheets of homogenized tobacco paper, natural leaf, rolling paper, and/or sheets of other smokable materials. One embodiment includes sheets comprised of different smokable materials chosen from any combination of the following types of materials: natural leaf, homogenized tobacco paper, pipe tobacco, different types of flavored tobacco, tea leaves, kanna, blue lotus, *salvia, salvia eivinorm*, wild dagga, kratom, herbal non-tobacco, Celandine Poppy, Mugwort, Purple Lavender Flowers, Coltsfoot Leaf, Ginger root, California Poppy, *Sinicuichi*, St. John's Wort, *Capillarius* herba, Yerba Lenna Yesca, *Calea Zacatechichi, Leonurus Sibericus* Flowers, Wild Dagga Flowers, Klip Dagga Leaf, Damiana, Hookah, *Hernia salicifolia*, Kava Kava, *Avena Sativa*, scotch broom topps, Valarian, *capillarius*, herba, Wild clip dagga, *Leonurus sibiricus*, Kanna, Sinicuichi, and/or *lactuca virosa.*

In various embodiments the separate form casings can be comprised of one or more of the following materials or combinations of materials: filter material, sponge, cotton, paper, cardboard, wood, metal, tobacco, hemp, hemp paper, clove, mir, willow bark, dogwood *cornus* sp, red osier, pipsissewa, *chimaphila, pyrola*, kinnikinnik, *arctostaphylos uva-ursi*, camomile herbs, manzanita, shrubby *arctostaphylos* sp, madrone, *arbutus menziesii*, blackberry, *rubus* sp, scotch broom, *cytisus, scoparius, cannabis*, hemp THC-free, *calamus*, mullein, and/or *verbascum thapsus*. In various embodiments form casings can be comprised of sticks, tobacco sticks, and/or pipe cleaners. bark, In one embodiment filter material can be comprised of acetate, paper, plastic, polymer, cotton, charcoal, and/or a combination of one or more of the specified materials.

One embodiment provides a separate form casing having filler material at least partially contained by anon-smokable outer holder. In one embodiment, an outer portion of non-smokable material contains the tobacco filler and separates the filler from the inner shell and outer pre-rolled sheet. In one embodiment the separate form casing supports the inner shell and outer pre-rolled sheet which can be contained inside the separate form casing with an outer layer of the form casing containing tobacco filler material.

One embodiment provides a separate form casing having moisturizing agents which can permeate and/or migrate from the form casing to the inner shell and outer pre-rolled sheet.

One embodiment provides a separate form casing having flavoring agents which can permeate and/or migrate from the form casing to the inner shell and outer pre-rolled sheet.

One embodiment provides a separate form casing having scenting agents which can permeate and/or migrate from the form casing to the inner shell and outer pre-rolled sheet.

One embodiment includes a cigar tip which can be used with the finished tobacco products. One embodiment includes the a cigar tip attached to the inner shell and outer pre-rolled sheet before these are formed into a finished cigar.

One embodiment includes an outer wall of the inner shell having a means to enhance diffusion and/or migration of flavoring, scenting, and/or moisture from the inner volume of the inner shell to the outer pre-rolled sheet.

In one embodiment the means for enhancement of diffusion and/or migration includes a plurality of openings. In one embodiment the plurality of openings are randomly spaced about the outer wall of the inner shell. In one embodiment the plurality of openings are symmetrically spaced about the outer wall of the inner shell.

One embodiment of the method enables an end user to make his or her own custom finished tobacco products with a selected, custom filler material/blend of filler material. The method preferably includes the use of a liquid for moisturizing, and also preferably includes flavoring and/or scenting. The liquid can be, in whole or in part, water, alcohol, solvent, oil, propylene glycol, ethyl alcohol, glycerin, benzyl alcohol as examples. The liquid can be flavored and/or scented with items such as for example apple, apple martini, berries, blueberry, champagne, chocolate, coco/vanilla, cognac, cosmo, gin, grape, honey, lychee, mango, menthol, mint choco, peach, piñ a colada, punch, purple, rum, strawberry/kiwi, vanilla, watermelon, wet cherry, and/or whiskey.

The flavors are preferably added to the form casings and/or pre-rolled sheets with a liquid. This flavored liquid is typically applied at levels of between about 0.01 to 45% by weight, and preferably between about 0.1% to 10% by weight. This flavored liquid is typically applied to the at least one pre-rolled sheet with a carrier liquid such as ethyl alcohol, propylene glycol, water or the like. Glycerin and invert sugar can also be used as a carrier. Some humectants can also be used, however, little or no humectants can be used. In general terms, the flavors can be provided by botanical extracts, essential oils, or artificial flavor chemicals, any one of which or a combination thereof mixed with a carrying solvent such as propylene glycol, ethyl alcohol, glycerin, benzyl alcohol, or other alcohol, for example. Other flavors can include cocoa, licorice, coffee, vanilla or other botanical extracts. Essentials oils can be used such as wine essence, cognac oil, rose oil, mate or other oils.

In various embodiments instructions can be provided with the packaging (or on the packaging) showing one or more of the steps of unrolling the attached outer pre-rolled sheet to expose the inner shell, opening the inner shell to access the interior volume, filling the interior volume with a consumer's custom tobacco filler material, closing the inner shell, and re-rolling the attached outer pre-rolled sheet about the inner shell to form a custom made cigar or cigarette.

BRIEF DESCRIPTION OF THE DRAWINGS

Reference will now be made to the drawings, wherein like parts are designated by like numerals, and wherein:

FIGS. 20A through 20C are perspective views illustrating the steps of unrolling, opening, and re-rolling a custom made cigar from an alternative embodiment of inner shell having outer wall with openings for migration of moisture, flavoring, and/or scenting.

FIG. 20D is a perspective view schematically illustrating migration of moisture, flavoring, and/or scenting from the inner shell shown in FIGS. 20A through 20 where the outer pre-rolled sheet has been removed for clarity (and also schematically indicating that such alternative inner shell would not be smokable without the outer pre-rolled sheet being rolled thereon because of air flow would be circumvented along the longitudinal length of the inner shell.

FIG. 6 is used.

DETAILED DESCRIPTION OF AT LEAST ONE PREFERRED EMBODIMENT

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner. Reference will now be made to the drawings, wherein like parts are designated by like numerals.

Figure 1:
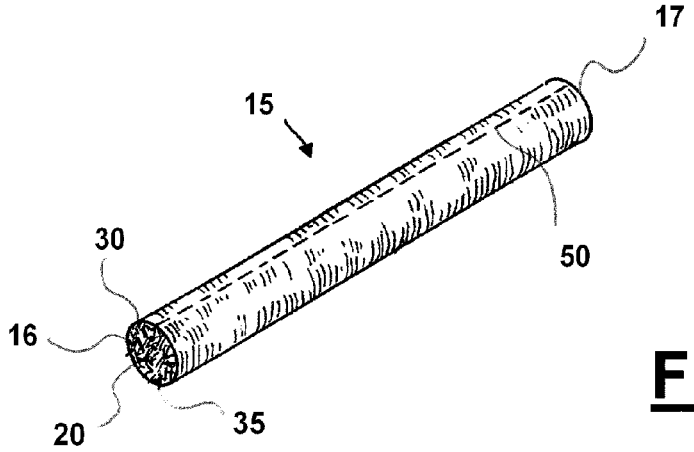
FIG. 1 is a perspective view of one embodiment of an inner shell.

FIG. 1 is a perspective view of one embodiment of an inner shell 15. In this figure is a perspective view of a preferred embodiment showing perforations along a longitudinal line 50 of inner shell 15. Inner shell 15 can include outer wall 30 containing a volume 35, and have first end 16 and second end 17. Inside volume 35 can be tobacco filler material 20. Inner shell 15 can be made in any desired length and with a predetermined diameter for volume 35.

Outer wall 30 can be comprised of one or more layers of material such as a binder attached to a wrapper layer.

Outer wall 30 can be comprised of smokable materials chosen from any combination of the following materials: natural leaf, homogenized tobacco paper, pipe tobacco, different types of flavored tobacco, cellulose (clear, opaque, or colored), paper, tea leaves, kanna, blue lotus, salvia, salvia eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, *Capillarius* herba, Yerba Lenna Yesca, *Calea Zacatechichi, Leonurus Sibericus* Flowers, Wild Dagga Flowers, Klip Dagga Leaf, Damiana, Hookah, *Hernia salicifolia*, Kava Kava, *Avena Sativa*, scotch broom topps, Valarian, *capillarius*, herba, Wild clip dagga, *Leonurus sibiricus*, Kanna, *Sinicuichi,* and/or *lactuca virosa.*

Figure 2:
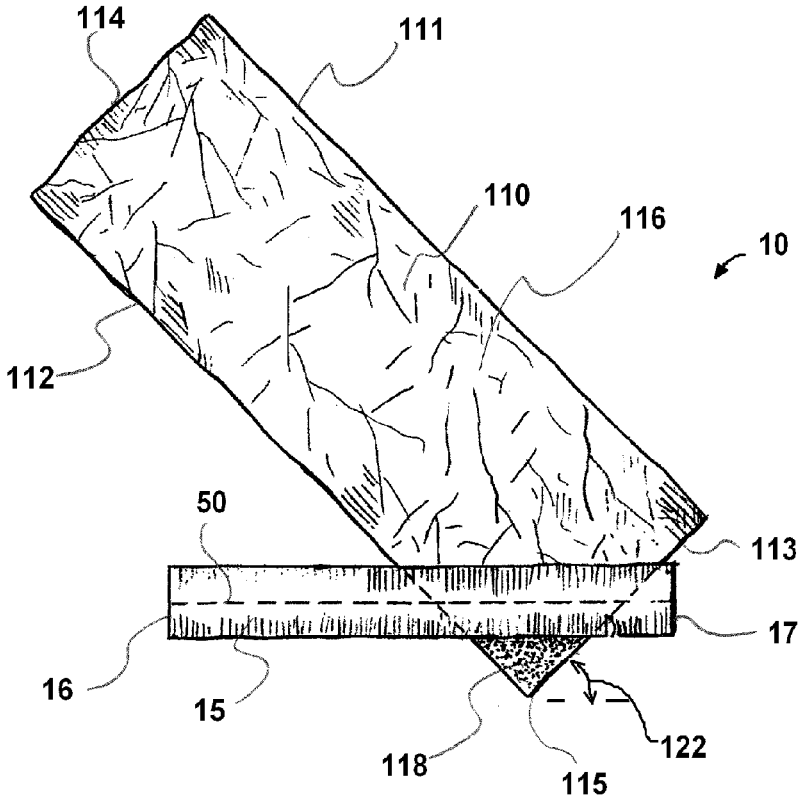
FIG. 2 is a perspective view of the inner shell of FIG. 1 being attached to an outer pre-rolled sheet (before the sheet is pre-rolled) where the attachment is on a corner of the sheet and the sheet will be spirally wrapped about the inner shell.
Figure 3:
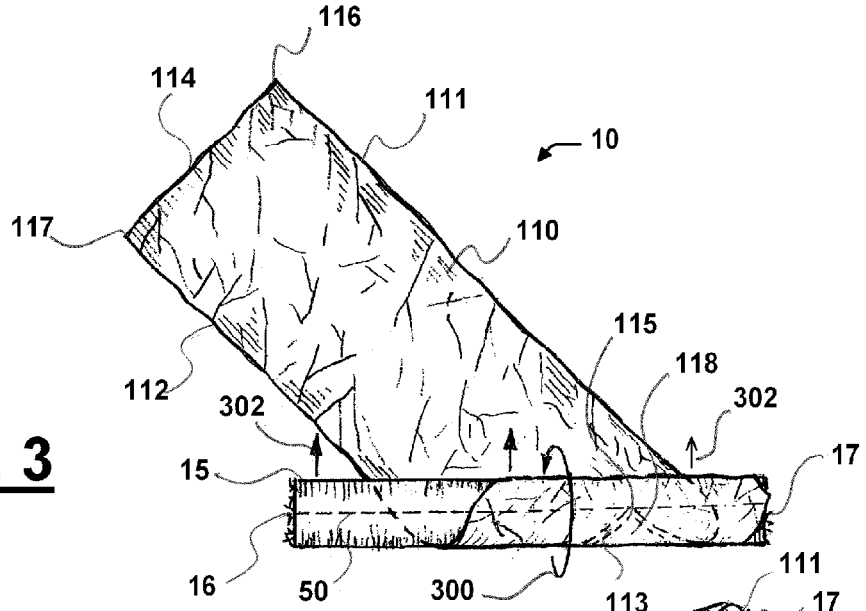
FIG. 3 is a perspective view illustrating the method of pre-rolling the attached outer pre-rolled sheet around the inner shell of FIG. 1.
Figure 4:
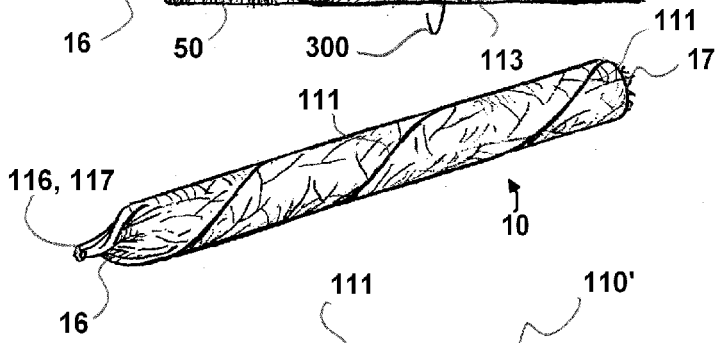
FIG. 4 is a perspective view of the inner shell and attached outer pre-rolled sheet of FIG. 2 before the unit is packaged for sale.

FIGS. 2 through 4 show the steps in making an inner shell and pre-rolled sheet from inner shell 15 and sheet 110. FIG. 2 is a perspective view of the step of inner shell 15 being attached to an outer pre-rolled sheet 110 (before the sheet is pre-rolled) where the attachment is on a corner 115 of sheet 110; and where sheet 110 will be spirally wrapped about inner shell 15. Adhesive (e.g., cigar glue) can be used to make the attachment. In this embodiment sheet 110 will be spirally wrapped about inner shell so sheet is attached at an angle 122 (e.g., forty five degrees) and located closer to one end 17 if inner shell. Preferably, corner 115 is attached so that it is located adjacent but not covering perforated line 50. As will be seen below such connection will allow perforated line to be easily opened along the length of inner shell 15. Also preferably, the amount of sheet 110 adhesively attached to inner shell 15 should not extend past perforations 15 when sheet 110 is spirally wrapped about inner shell 15. Additionally, it is preferred that one corner (e.g., the corner between edges 111 and 113) be located adjacent end 17—so that pre-rolled sheet 110 will substantially cover inner shell 15 when spirally wrapped.

FIG. 3 is a perspective view of the step of outer pre-rolled sheet 110 being wrapped about inner shell 15. Arrow 300 schematically represents the step of rolling.

Plurality of arrows 302 schematically represent the direction in which inner shell will be moved relative to sheet 110. During the rolling process inner shell serves as a casing or form mandrel for pre-rolling sheet 110. When sheet 110 is so pre-rolled, after being unrolled it will have a "rolling memory" tending to cause it to roll up again and assisting in the process of making a custom made cigar or cigarette. Additionally, outer wall of inner shell 30 will also have a "rolled memory" tending to cause it to roll up again and assisting in the process of making a custom make cigar or cigarette. The dual action of the "rolling memory" and "rolled memory" better assists an individual in making a custom made cigar or cigarette. The process of making a custom made cigar or cigarette will be described below.

FIG. 4 is a perspective view of the inner shell and attached outer pre-rolled sheet of FIG. 2 before the unit is packaged for sale. Because edge 114 extends past first end 16, corners 116 and 117 can be "twisted shut" to close off first end 16. As will be described below, to make a custom cigar or cigarette 10', corners 116 and 117 will be "untwisted" to begin the unrolling process for sheet 110. Alternatively, corner 117 of edge 114 can be located such that it substantially aligns with first end 16. Also alternatively, after sheet 110 is rolled, first end can be cut or snipped so corners 116 and 117 are removed and first end is again exposed.

Figure 11:
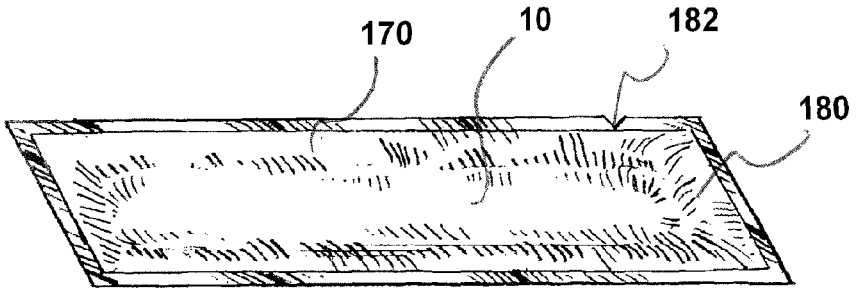
FIG. 11 is an exterior perspective view of the inner shell and attached outer pre-rolled sheet of FIG. 4 packaged for sale in a pouch.

Rolled sheet 110 and inner shell 15 can be placed in packaging for sale, such as that shown in FIG. 11. Alternatively, sheet 110 and shell 15 can be placed in an additional moisture barrier 160 (such as cellophane, plastic, foil, wax paper, and/or other materials which can inhibit moisture loss). Also alternatively, although not shown an intermediate (and unattached) sheet can be placed on the upper surface 116 of sheet 110 to prevent sheet 110 from sticking to inner shell 15 after sheet 110 is rolled about inner shell 15. This intermediate sheet can be of the same construction as moisture barrier. The intermediate sheet would preferably be about the same size as sheet 110, but would not be connected to either sheet 110 or inner shell 15. This intermediate sheet would assist in the unrolling process of sheet 110 from about inner shell 15. Additionally, this intermediate sheet would inhibit moisture loss from both inner shell 15 and sheet 110. When making the custom cigar 10', this intermediate sheet would be removed and discarded after sheet 110 was unrolled from inner shell 15. If the intermediate sheet is used, is should be removed from unit 10 because this intermediate sheet is not smokable.

It is envisioned that the attachment between sheet 110 and inner shell 15 can be accomplished through a variety of means and in a variety of methods. Sheet 110 can be attached transversely to the longitudinal axis of inner shell 15, or can be attached at an acute or obtuse angle relative to the longitudinal axis of inner shell 15(described above via attachment with adhesive 118 on corner 115).

Additionally, although not shown even if attached transversely, sheet 110" can include a rectangular section and a trapezoidal (or triangular) section where the trapezoidal (or triangular) section provides the appearance (from the exterior) of being spirally wrapped—even when transversely wrapped about inner shell 15. In this embodiment, the rectangular section can be attached to inner shell 15 next to or adjacent to plurality of perforations 50.

Figure 5:
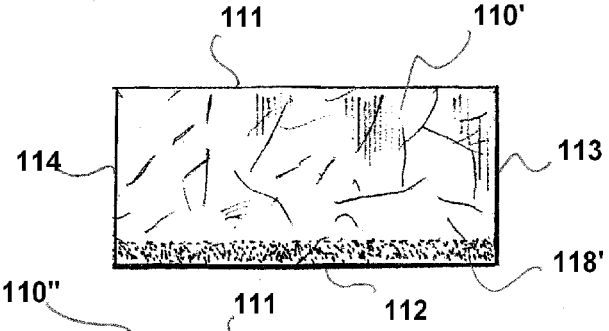
FIG. 5 is a top view of an alternative embodiment of an outer pre-rolled sheet (before being attached to the inner shell and before being pre-rolled).
Figure 6:
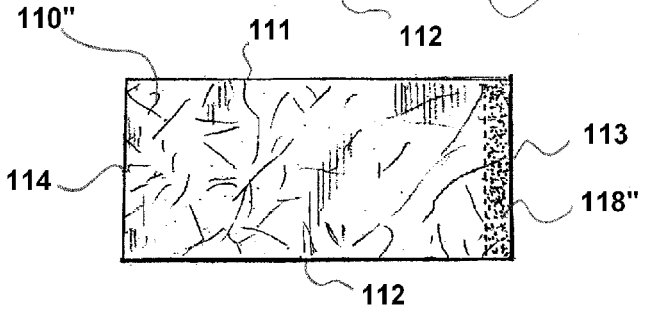
FIG. 6 is a top view of an alternative embodiment of an outer pre-rolled sheet (before being attached to the inner shell and before being pre-rolled).

In various embodiments sheet 110 can be attached to inner shell 15 transversely (or at one of the edges of sheet 110). FIG. 5 is a top view of an alternative embodiment of outer pre-rolled sheet 110' (before being attached to inner shell 15 and before being pre-rolled). Sheet 110' has adhesive 118' along a substantial portion of longer edge 112 (edge 112 being longer than edge 113)—instead of on one of the corners. As will be described below sheet 110' can be attached to inner shell 15 with edge 112 parallel to the longitudinal length of inner shell 15. FIG. 6 is a top view of another alternative embodiment of an outer pre-rolled sheet 110" (before being attached to inner shell 15 and before being pre-rolled). Sheet 110" has adhesive 118" along a substantial portion of shorter edge 113 (edge 113 being shorter than edge 112)—instead of on one of the corners. As will be described below sheet 110" can be attached to inner shell 15 with edge 113 parallel to the longitudinal length of inner shell 15.

In various of the embodiments inner shell 15 with tobacco filler material 20, outer pre-rolled sheet 110 can be smoked without removing tobacco filler material (e.g., customizing).

Inner shell 15 can come in a variety of embodiments. Generally, inner shell 15 includes an outer wall 30 enclosing an inner volume 35, and has a means for opening outer wall 30 to access the inner volume 35 for adding the selected tobacco filler 22 for making the custom cigar or cigarette Inner shell 15 serves as a form mandrel or casing with regard to attached outer pre-rolled sheet 110 so that sheet 110 is not crushed, damaged, or misshaped before a consumer is ready to create the custom made cigar or cigarette. In one embodiment inner volume 35 can be pre-filled with tobacco filler material 20 which both structurally supports outer wall 30 (allowing inner shell 15 to be used as a mandrel or form casing relative to pre-rolled sheet 110), and provides the consumer the option to use a portion of the tobacco filler material 20 in combination with new tobacco filler material 22 to ultimately form a custom made cigar or cigarette.

In various embodiments inner shell 15 can be opened along a substantial portion (although not its entire longitudinal length). In various embodiments inner shell 15 can be opened about 50, 55, 60, 60, 65, 70, 75, 80, 85, 90, 91, 92, 93, 94, 95, 96, 97, 98, 99, and/or 100 percent of its longitudinal length. In various embodiments ranges between any of the two above specified percentages can be used for opening the longitudinal length. In various embodiments the means for opening inner shell 15 can stop at any of the above specified percentages or ranges of percentages. Opening only along a substantial portion of the along the longitudinal length can assist some users (compared to opening the entire longitudinal length of inner shell 15) in rolling again inner shell 15 (now filled with new tobacco filler material 22 replacing all or a portion of original tobacco filler material 20), and outer pre-rolled sheet 110 when making the final custom cigar or cigarette.

Figure 7:
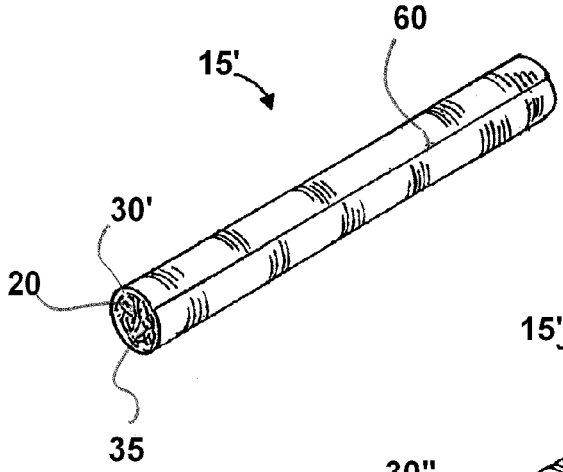
FIG. 7 is a perspective view of an alternative embodiment of an inner shell.

FIG. 7 is a perspective view of an alternative embodiment of inner shell 15' having an etched, creased, or cut line 60 along the longitudinal length of inner shell 15'. Etched, creased, or cut line 60 allows inner shell 15' to be easily opened by user who wishes to replace tobacco filler material 20 with a select tobacco filler material 22.

Figure 8:
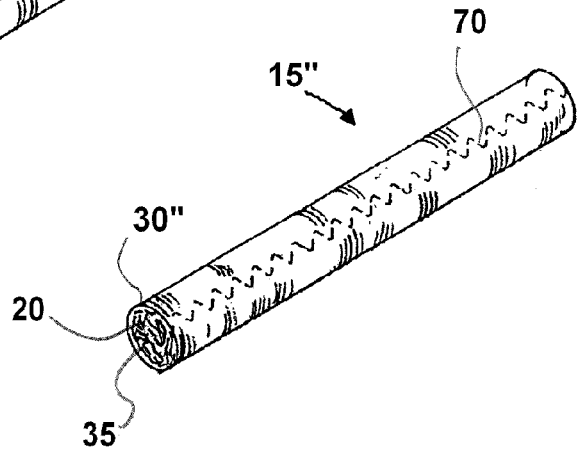
FIG. 8 is a perspective view of another alternative embodiment of an inner shell.

FIG. 8 is a perspective view of another alternative embodiment of inner shell 15" having irregularly shaped perforations 70 along its longitudinal length. Perforations 70 should be small enough so that air flow will be minimized through the perforations, but large enough to allow a user to easily separate the shell if desired. In this embodiment irregularly shaped perforations 70 are serrated. In other embodiments irregularly shaped perforations 70 can be spiral, sinusoidal, or other irregular shapes compared to a straight line along the longitudinal length of inner shell 15).

Figure 9:
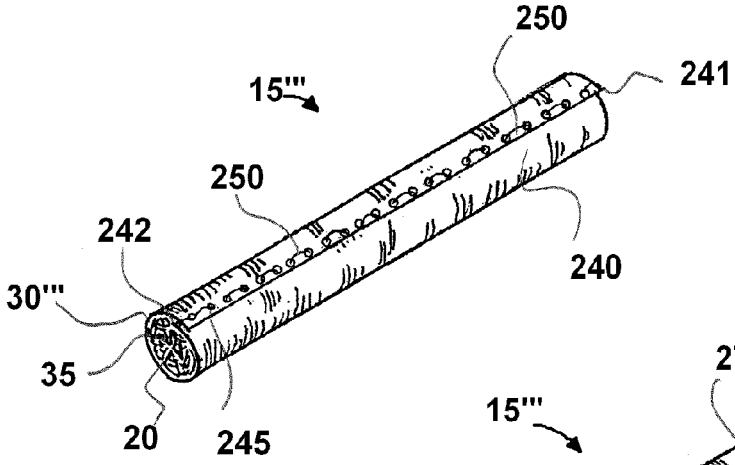
FIG. 9 is a perspective view of another alternative embodiment of an inner shell.

FIG. 9 is a perspective view of another alternative embodiment for inner shell 15'''. Outer wall 30''' is comprised of sheet 240 which can include a plurality of openings 245,246 respectively located on edges 241,242. In this embodiment a tie 250 which can be used with sheet 240 which can be threaded through openings 245,246. Inner volume 35 can be filled with tobacco filler material 20. Tie 250 can be threaded through openings 245,246 to hold inner shell 15''' in a cylindrical shape (allowing it to be used as a form mandrel or casing for attached outer pre-rolled sheet 110). Alternatively openings 245,245 can be formed after sheet 240 has been rolled into a cylindrical shape and filled with tobacco filler material 20. Openings 245,246 can be formed at the same time tie 250 is inserted into the openings, such as by stitching with a needle or sewing machine. Tie 250 is shown relatively loose but can be as tight as desired causing edges 241,242 to touch. When a user desires to insert his tobacco fill material 22 of choice, tie 250 can be cut or untied from openings 245,246 and edges 241,242 can be pulled apart providing access to inner volume 35. All or a portion of tobacco filler material 20 can be removed from inner volume 35 and replacement tobacco filler 22 material can be placed in inner volume 35 while edges 241,242 are held apart. Edges 241,242 will have a memory wherein they will tend to roll up in the directions of arrows 247,248 allowing the user to easily make a new cigar or cigarette in combination with attached outer pre-rolled sheet 110.

Figure 10:
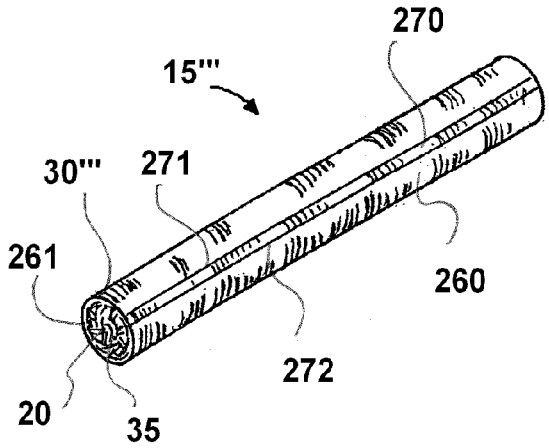
FIG. 10 is a perspective view of another alternative embodiment of an inner shell.

FIG. 10 is a perspective view of another alternative embodiment of an inner shell 15"". In this embodiment outer wall 30"" comprises sheet 260 with an area 270 which can be easily separate when desired Inner volume 35 has been filled with tobacco filler material 20 (allowing inner shell 15"" to be used as a form mandrel or casing for attached outer pre-rolled sheet 110). Using area 270 to open outer wall 30"" creates edges 271,271 in sheet 260 which can be moved apart providing access to inner volume 35. Area 270 can be formed by causing it to be of less thickness than the remaining portion of sheet 260. For example, where sheet 260 comprises a layer of binder and a layer of wrapper, area 270 may be formed by removing the binder or removing the wrapper thereby making it weaker than the remaining part of sheet 260. Various other processes can be applied to area 270 to make it weaker than the remainder of sheet 260—such as scarring, scratching, etching etc. Where stress is applied to area 270 sheet 260 will separate along the longitudinal length of area 270 and into edges 271, 262.

FIGS. 11 through 19 illustrate the steps in one embodiment for making a custom made cigar or cigarette using inner shell and attached pre-rolled sheet 10. FIG. 11 is an exterior perspective view of the inner shell and attached outer pre-rolled sheet 10 packaged for sale in a pouch 170. Pouch 170 can include notch 182 for ease of opening forming flap 180. Additionally, pouch 170 can include a reusable seal such as a zip-lock type seal to seal again pouch 170 even after pouch 170 has been opened.

Figure 12:
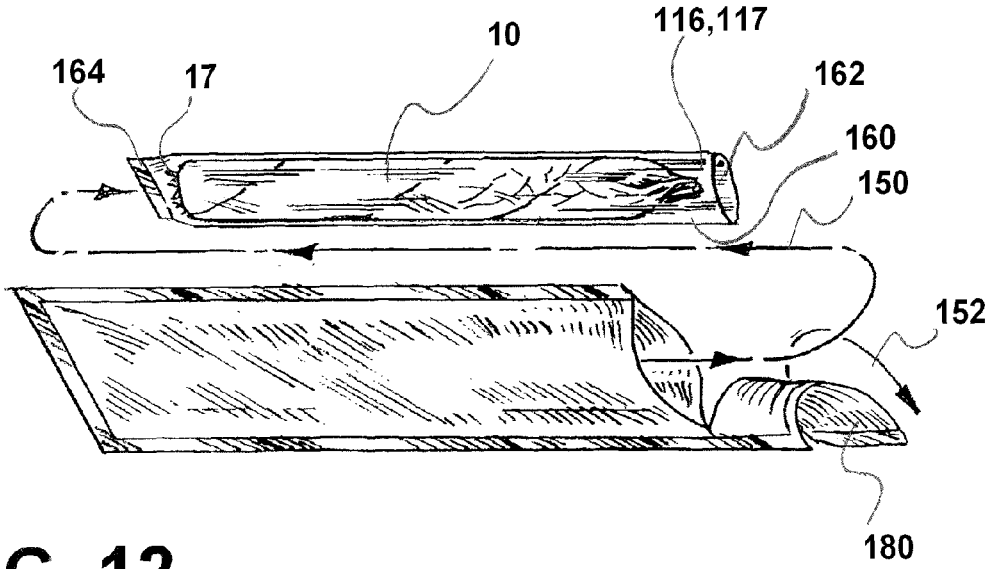
FIG. 12 is a perspective view of the inner shell and attached outer pre-rolled sheet of FIG. 11 being removed from the pouch of FIG. 11.

FIG. 12 is a perspective view of the step of pouch 170 being opened by tearing open flap 180 (schematically indicated by arrow 152), and tobacco product 10 being removed from pouch 170 (schematically indicated by arrows 150). In this embodiment tobacco product 10 is also packaged in a wrapper 160 for moisture control. Wrapper 160 is optional.

Figure 13:
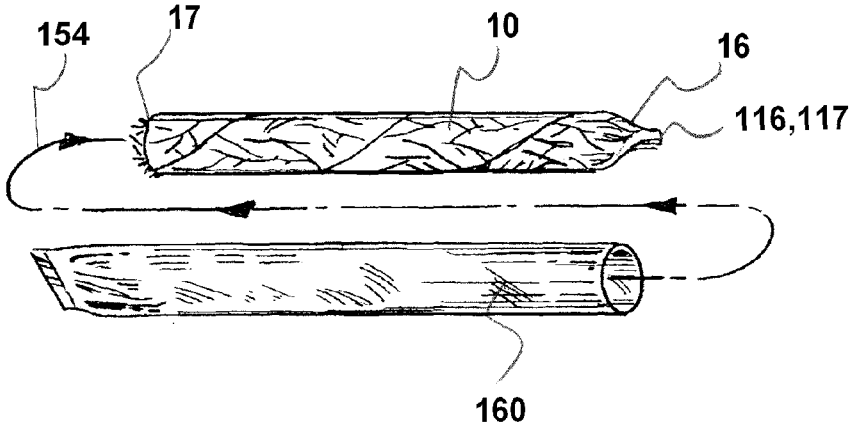
FIG. 13 is a perspective view of the inner shell and attached outer pre-rolled sheet being removed for an internal wrapper.

FIG. 13 is a perspective view of the step of tobacco product 10 being removed from optional wrapper 160 (schematically indicated by arrows 154). Here, wrapper 160 is shown being closed on second end 164, and open on first end 162. Optionally, wrapper can also be closed on first end 162. Also optionally, wrapper 160 can also be opened on second end 164.

Figure 14:
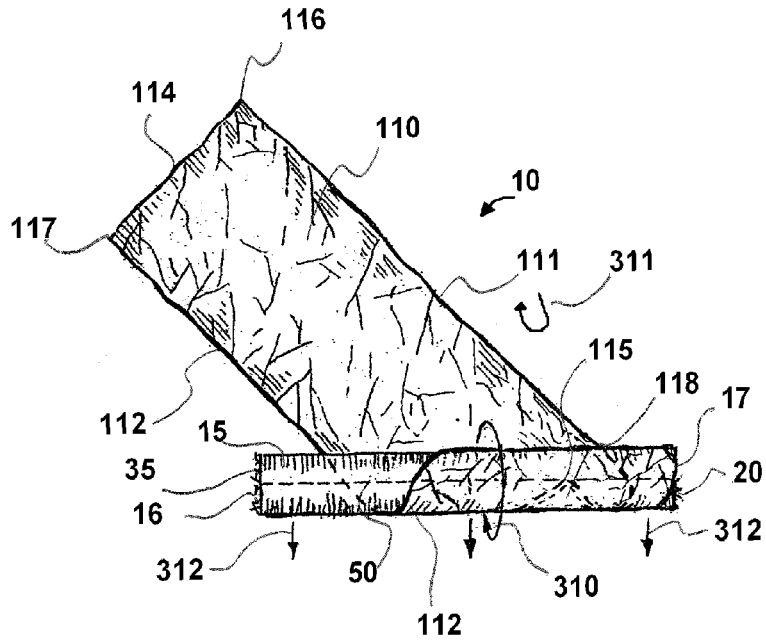
FIG. 14 is a perspective view illustrating the step of unrolling the outer pre-rolled sheet attached to the inner shell of FIG. 1.

FIG. 14 is a perspective view of the step of unrolling outer pre-rolled sheet 110 attached to inner shell 15 (schematically indicated by arrow 310). Before unrolling can begin, corners 116 and 117 should be "untwisted" (shown twisted in FIG. 13) Inner shell 15 is unrolled in the direction of arrow 310. Alternatively, sheet can be unwrapped in the opposite direction of arrow 310. Alternatively, both (unwrapping of sheet 110 and unrolling of shell 15) can be done simultaneously.

Figure 15:
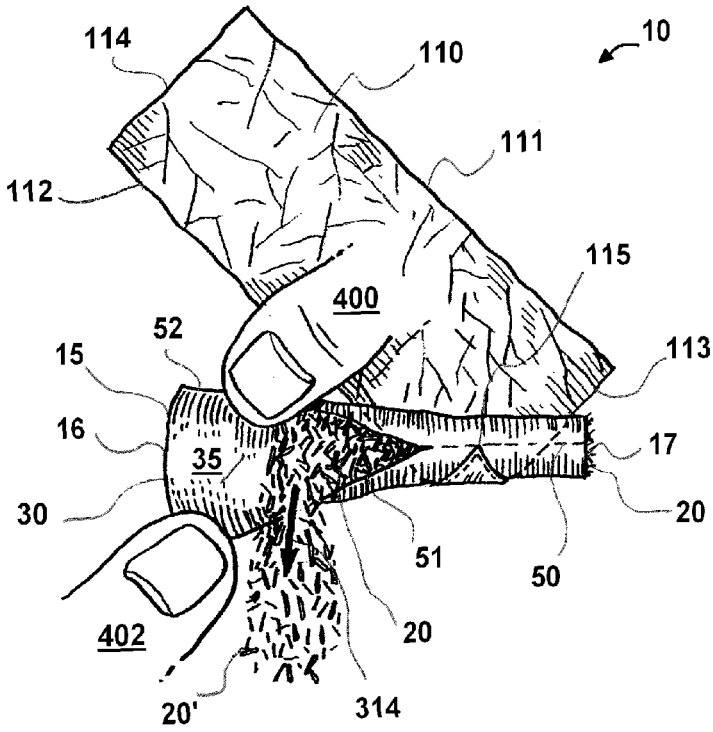
FIG. 15 is a perspective view illustrating the step of opening the outer wall of the inner shell.

FIG. 15 is a perspective view of the step of opening outer wall 30 of inner shell 15. Here, outer wall 30 can be opened by pushing down and apart (schematically shown by thumb 400 separated from thumb 402) on plurality of perforations 50 along the longitudinal length of inner shell 15. As outer wall 30 is opened edges 51 and 52 are created and can be moved apart to access interior volume 35. Arrow 314 schematically indicates the step of removing a portion of tobacco filler 20 previously contained in inner volume 30. The removed tobacco filler is labeled as 20'. All or part of tobacco filler 20 can be removed. Now, interior volume 35 is ready to accept the consumer's tobacco filler of choice.

Figure 16:
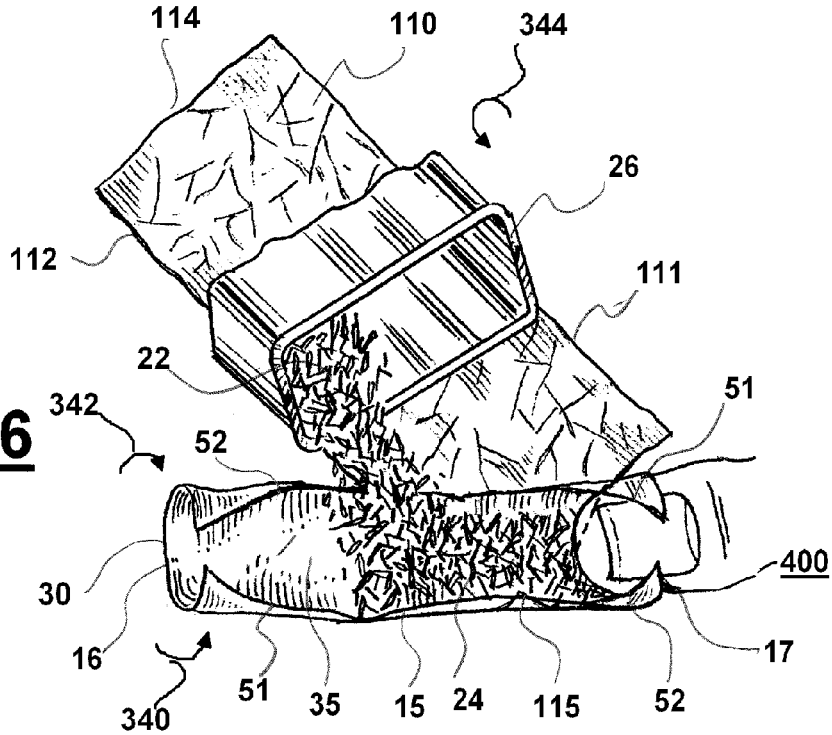
FIG. 16 is a perspective view illustrating the step of moving apart the edges of the outer wall and adding tobacco filler material to the exposed inner volume of the inner shell.

FIG. 16 is a perspective view of the step of adding a selected custom tobacco filler material to inner volume 35. First, edges 51 and 52 of the outer wall 30 of inner shell 15 can be moved apart to expose inner volume 35. Thumb 400 can be used to keep apart edges 51 and 52. Arrows 340 and 342 schematically indicate the "rolling memory" of outer wall 30 wherein this rolling memory tends to cause edges 51 and 52 to move back towards one another (when edges 51 and 52 are moved apart). Such "rolling memory" greatly assists in the re-rolling process—after custom tobacco filler material 22 has been added to inner volume 35. Adding custom tobacco filler material to inner volume can be done through a variety of means—in FIG. 16 thumb 400 is placed adjacent end 17 to keep apart edges 51 and 52 when filling interior volume 35 with custom tobacco filler material 22. Tobacco filler material 22 is now added to the exposed inner volume 35 of inner shell 15. Here, tobacco filler material 22 can be added by pouring from container 26. Tobacco filler material 24 is the tobacco filler material which is contained in interior volume for the re-rolling process. Arrow 344 schematically indicates that attached pre-rolled sheet 110 also has a "rolling memory" which will tend to cause attached sheet 110 ro roll up again, and assist in the re-rolling process for completion of the custom made cigar or cigarette.

Figure 17:
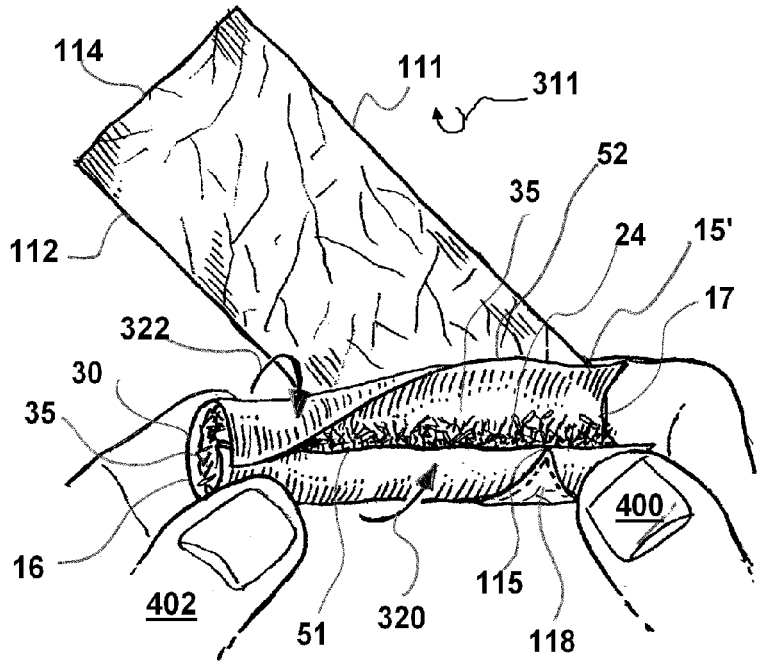
FIG. 17 is a perspective view illustrating the step of moving closer the edges of the outer wall to enclose the tobacco filler material added to the exposed inner volume of the inner shell.

FIG. 17 is a perspective view of the step of, after adding the selected tobacco filler material 22, then moving closer edges 51 and 52 of outer wall 30 to enclose tobacco filler material 24 now contained in exposed inner volume 35 of inner shell 15. In this step arrows 320 and 322 schematically indicated the step of moving closer edges 51 and 52—this is done by hands and fingers 400 and 402. Edges 51 and 52 will be moved closer together and then pass each other causing outer wall 30 to at least partially overlap itself when closing interior volume 35. Closing interior volume 35 with tobacco filler material 24 sets up the final steps of re-rolling.

Figure 18:
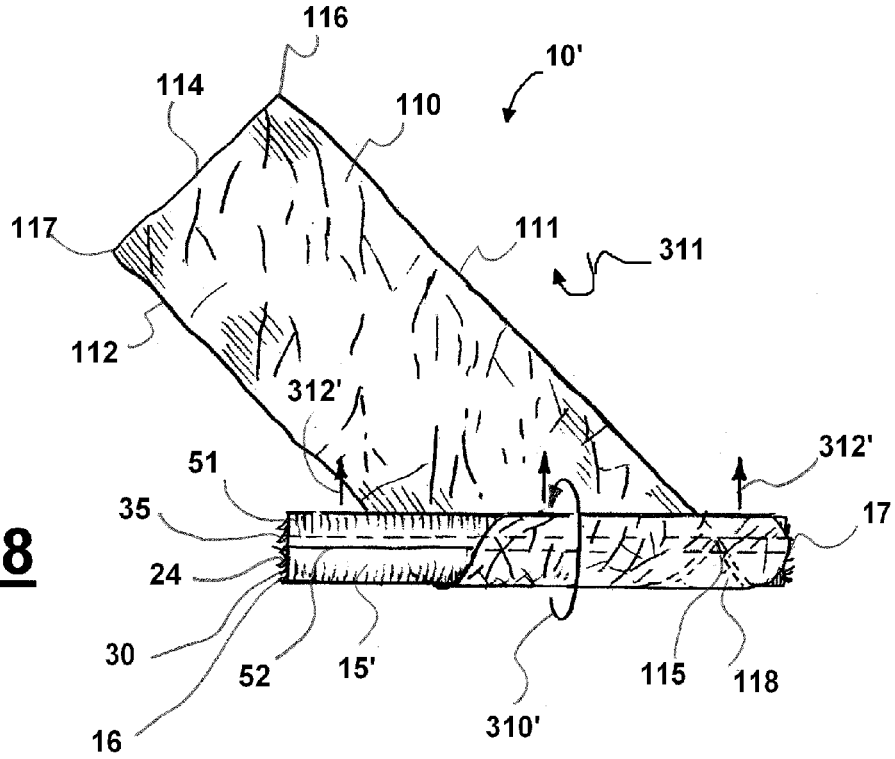
FIG. 18 is a perspective view illustrating the step of adding rolling the attached outer sheet around the inner shell.

FIG. 18 is a perspective view of the step of rolling attached outer sheet 110 around inner shell 15. As shown in FIG. 18 edges 51 and 52 have been moved closed to each other (compared to that shown in FIG. 16 where interior volume 35 was exposed), and outer wall 30 is in a partially overlapped state or condition. In this figure edge 51 is shown under edge 52. Alternatively, edge 52 can be placed under edge 51. Also alternatively, edges 51 and 52 can be placed touching each other. Interior shell 15 can then be rolled in the direction of arrow 310', and linearly in the direction of arrows 312' until attached outer sheet 110 is completely rolled (and wrapped) around inner shell 15. During this process inner shell 15 holds selected tobacco filler material 24 in interior volume 30. Additionally, attached pre-rolled sheet 110 via corner 115 can also assist in keeping closed inner shell 15—such assistance can be by a force applied by sheet 110 on inner shell 15. Arrow 311 schematically indicates the rolling memory of sheet 110 assisting in the rolling of sheet 110 over inner shell 15. Arrows 320 and 322 (in FIG. 17) schematically indicate the rolling memory of inner shell 15 assisting in keeping shell 15 closed during the rolling process. When sheet 110 has been completely rolled around inner shell 15, corners 116 and 117 can be twisted together. Alternatively, the rolled tobacco product 10' can be held at first end 16 (without twisting together corners 116 and 117) to prevent any unrolling (of sheet 110) during the smoking process. In this alternative embodiment second end 17 can be lit and first end 16 can be placed in the mouth of the smoker.

Although not shown, sheet 110 can be constructed/configured such that when rolled around inner shell 15, corner 117 substantially lines up with first end 16 (or extends over only a small amount. Alternatively, after the re-rolling process a portion of sheet 110 can be cut off from first end 16 (or torn off) so that it does not get in the way of the smoker when first end 16 is placed in the mouth of the smoker, or block air flow from second end 17 to first end 16.

Figure 19:
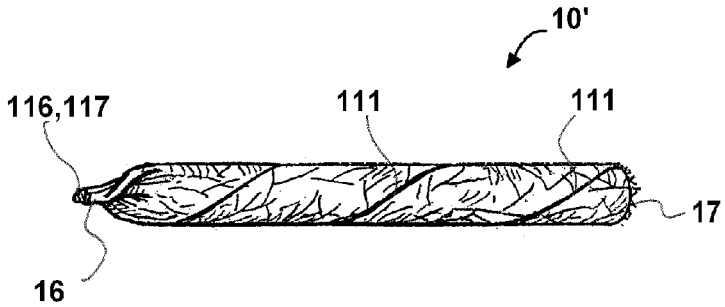
FIG. 19 is a perspective view of the custom made finished cigar which is now ready to smoke.
Figure 21:
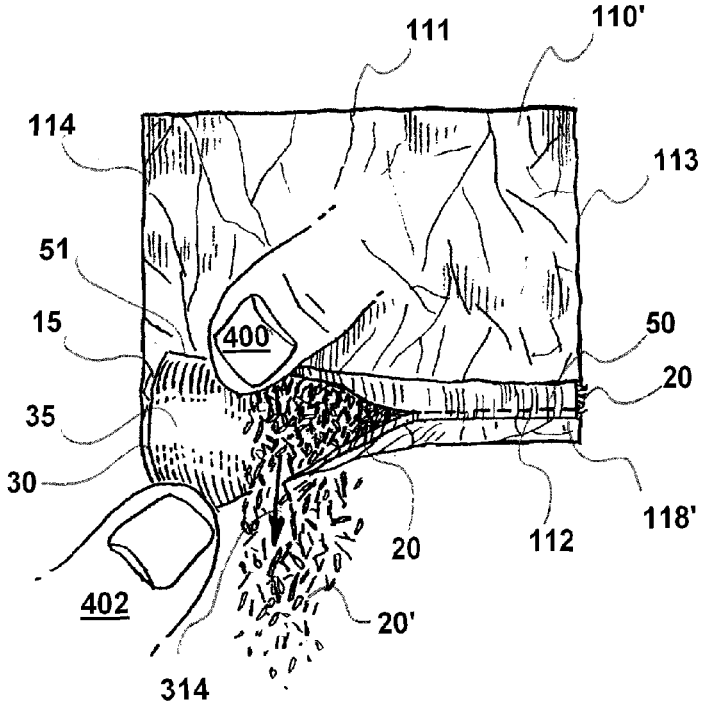
FIGS. 21 through 24 are perspective views illustrating the steps of opening the inner shell, filling such exposed inner volume with tobacco filler of choice, closing the inner shell, and re-rolling the closed inner shell and attached outer pre-rolled sheet to form a finished cigar or cigarette, where the alternative outer pre-rolled sheet of FIG. 5
Figure 22:
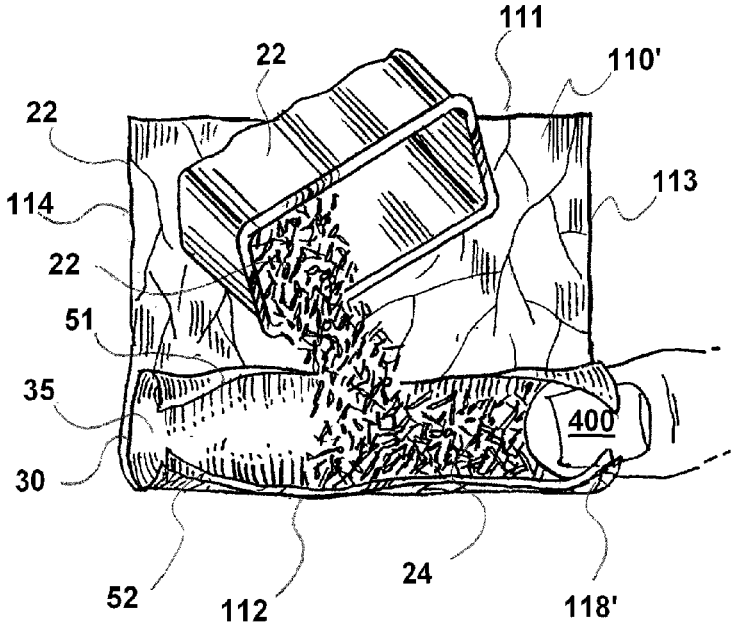
Figure 23:
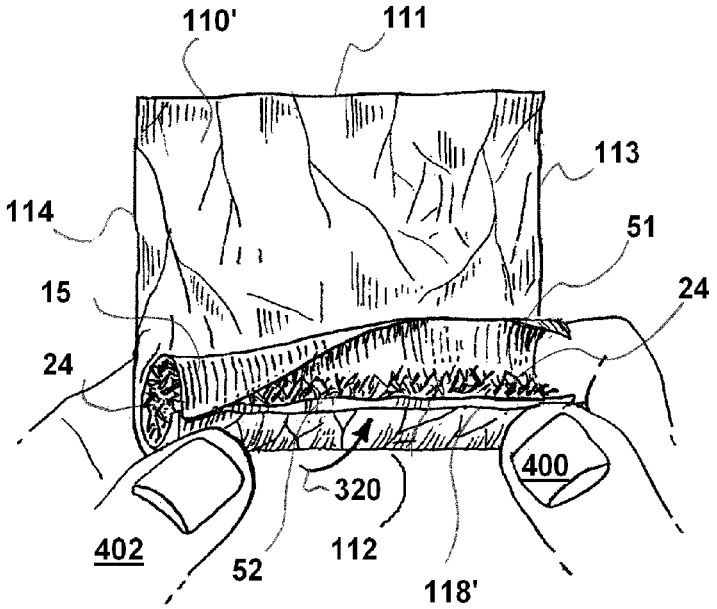
Figure 24:
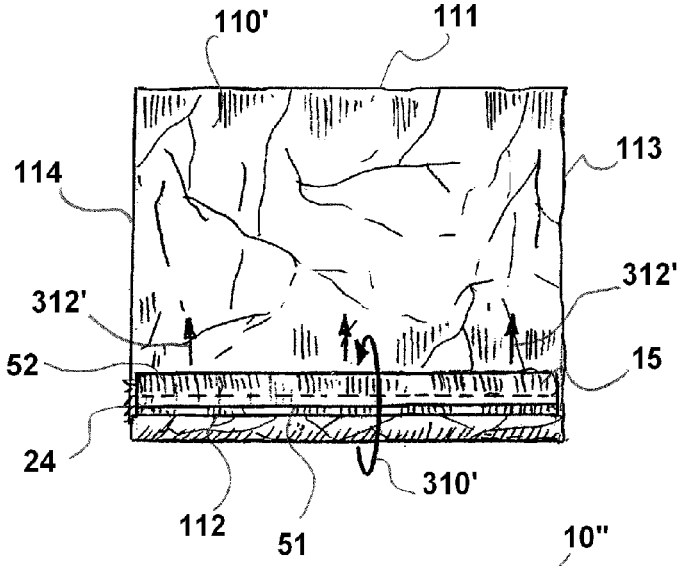

FIG. 19 is a perspective view of the custom made finished cigar or cigarette 10' which is now ready to smoke. First end 16 can be lit and second end 17 can be placed in the mouth of the smoker.

FIGS. 20A through 20C are perspective views illustrating an alternative embodiment for inner shell 100, and the steps of unrolling, opening, and re-rolling a custom made cigar from an alternative embodiment of inner shell 100 having outer wall 101 with a plurality of openings 106 for migration of moisture, flavoring, and/or scenting between interior volume 108, and outer wall 101 and attached outer pre-rolled tobacco sheet 110. The steps of making a finished tobacco product with this alternative inner shell 100 are the same as those described above with inner shell 15. However, with inner shell 100, plurality of openings are added to assist in migration of moisture, flavoring, and/or scenting. FIG. 20D is a perspective view schematically illustrating migration of moisture, flavoring, and/or scenting from inner shell 100 where outer pre-rolled sheet 110 has been removed for clarity (and also schematically indicating through plurality of migration arrows 332) that such alternative inner shell 100 would not be smokable without the outer pre-rolled sheet 110 being rolled/wrapped thereon because of air flow would be circumvented along the longitudinal length of the inner shell.

Figure 25:
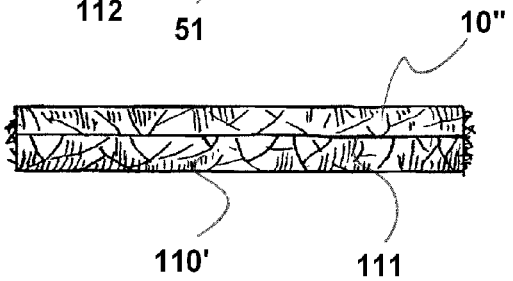
FIG. 25 is a perspective view of a custom made finished cigar or cigarette ready to smoke which was made from the steps illustrated in FIGS. 21 through 24.

FIGS. 21 through 24 are perspective views illustrating the steps of opening the inner shell 15 to expose the interior volume 35 and removing at least a portion of the original tobacco filler material 20 (FIG. 21), filling such exposed inner volume 35 with custom tobacco filler material 22 of choice (FIG. 22), closing exposed inner volume 35 (FIG. 23), and re-rolling inner shell 15 in attached outer pre-rolled sheet 110' (FIG. 24) to form a finished tobacco product 10' (FIG. 25). In this embodiment the alternative attached outer pre-rolled sheet 110' of FIG. 5 can be used. Outer pre-rolled sheet 110' can be attached to inner shell 15 by placing edge 112 adjacent to or next to plurality of perforations 50. As with other embodiments an adhesive 118' can be used for the attachment. The steps are substantially the same as those described in the embodiment shown in FIGS. 11 through 19 except edge 112 of sheet 110' is substantially transverse to (i.e., substantially perpendicular to) the longitudinal length of inner shell 15 and there is no requirement that part of sheet 110' be untwisted (during the unrolling process), and then re-twisted during the re-rolling process. FIG. 25 is a perspective view of a custom made finished cigar or cigarette 10" ready to smoke which was made from the steps illustrated in FIGS. 21 through 24. The steps illustrated in FIGS. 21 through 24 can also be used with alternative sheet 110" (shown in FIG. 6)—the difference being the longitudinal length of the finished cigar or cigarette 10"—sheet 110' (FIG. 5) will provide a longer longitudinal length finished tobacco product 10" compared to sheet 110' (FIG. 6)'.

Although FIG. 25 shows the finished product 10", it also is very similar to the starting product pulled out of the pouch before unrolling (this is because inner shell 15 is inside and cannot be seen). With the starting product which must be unrolled, to unroll edge 111 is unwrapped/unrolled from inner shell 15 to expose inner shell 15 so that inner shell can be opened along perforations 50 (shown in FIG. 21).

Figure 26:
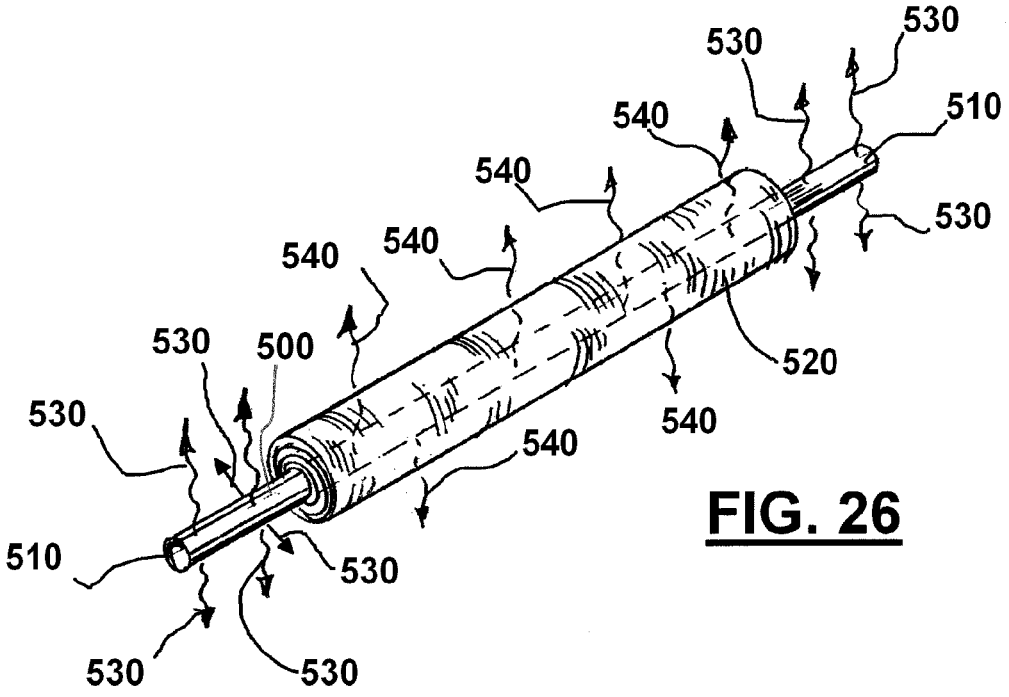
FIG. 26 shows an alternative embodiment of inner shell and attached outer pre-rolled sheet where a separate form mandrel comprises a material which tends to support migration of a substance such as moisture, tastes, and/or scent or contains such material and facilitates such migration into the inner shell and/or the outer attached pre-rolled sheet.

FIG. 26 shows an alternative embodiment of a non-smokable form casing 500 which can be used in place of tobacco filler material 20 to support inner shell 15 and attached outer pre-rolled sheet 110 where separate form mandrel 500 comprises a material which tends to support migration of a substance such as moisture, tastes, and/or scent or contains such material and facilitates such migration into the inner shell and/or the outer attached pre-rolled sheet. Here, the steps of forming a custom made cigar would be substantially similar to those shown in FIGS. 11 through 19, except that in opening inner shell 15 along plurality of perforations 50, form casing is removed from interior volume 35 instead of tobacco filler material 20.

Form casing/mandrel 500 is preferably formed from a rigid or flexible material in a form of a cylinder of a predetermined length and outer diameter. Form casing/mandrel 500 can be made either hollow, with a central opening, or as a solid body. It is desirable that form casing/mandrel 500 be substantially inflexible and strong enough to withstand forces applied to form casing/mandrel 500 when the unit is shipped to its ultimate selling outlet, and when attached outer pre-rolled sheet 110 unrolled from form casing/mandrel 500 and inner shell 15 is opened. In various embodiments form casing 500 can be comprised of one or more of the following materials or combinations of materials: filter material, sponge, cotton, paper, cardboard, wood, metal, tobacco, hemp, hemp paper, clove, mir, willow bark, dogwood *cornus* sp, red osier, pipsissewa, *chimaphila, pyrola*, kinnikinnik, *arctostaphylos uva-ursi*, camomile herbs, manzanita, shrubby *arctostaphylos* sp, madrone, *arbutus menziesii*, blackberry, *rubus* sp, scotch broom, *cytisus, scoparius, cannabis*, hemp THC-free, *calamus*, mullein, and/or *verbascum thapsus*. In various embodiments form casing 500 can be comprised of sticks, tobacco sticks, and/or pipe cleaners. bark, In one embodiment filter material can be comprised of acetate, paper, plastic, polymer, cotton, charcoal, and/or a combination of one or more of the specified materials. In one embodiment, form casing 500 can include two layers (inside and outside layers). The layers can be comprised of an aluminum/polymer/non-smokable outside layer and tobacco filler inside layer. Additionally, form casing 500 can include a perforated section with a gel interior to allow the gel to gain access to inner shell 15 and attached outer pre-rolled sheet 110. This gel interior can be used for moisturizing, flavoring, and/or scenting inner shell and sheet 110.

As part of the method, the tobacco products disclosed in this application can be sprayed with a liquid that preferably includes a flavoring.

As part of the method, the tobacco products disclosed in this application can be packaged in conventional containers and sold directly to customers who desire to roll their own tobacco products, but do not have the required finger dexterity. For example, they can be individually packaged in a pouch, bag, or box. In one embodiment multiple sets of tobacco products 10, 10' etc. can be packaged in a single zip-wrapper where the multiple sets are together pouched, bagged, or boxed. Alternatively, the individual sets can be pouched, bagged, or boxed. Units can be packaged in a zip-wrapper and the zip wrapper can be enclosed in a box. The box itself can be covered by a wrapper and include a window for viewing the contents.

In one embodiment, multiple sets of tobacco products 10, 10', etc. can each be individually wrapped and placed in a single carton opening at the top through a lid. The multiple sets can each be individually packaged in wrappers and such wrappers can have indicia which provides consumers with information concerning the sets of tobacco products, such as flavoring, scent, moisture, or other information. The carton can itself be covered by wrapper. Those skilled in the art will understand that various materials for wrapping can be used to enclosed the tobacco products. These include, but are not limited to, Low & High Density Polyethylene with EVA additive, Linear Low Density Poly, Polypropylene, Orientated Polypropylene, Cast Polypropylene, PVC, Polyester, Vaper Barrier packaging, Moisture Barrier packaging, Laminated packaging, Shrink film, Stretch Film, Foil Films (which can be translucent or opaque), Metalized Film, Cellophane, and Polyethylene Terephthalat. In addition to an "EVA" additive a barrier foil lamination can be used being either coated or metallized. The packaging, whether plastic, aluminum, or glass, keeps moisture in or dramatically slows down moisture loss from the sets of pre-rolled sheet(s). It is preferable that the wrapping material have adequate moisture resistant properties so that the tobacco product does not dry out before use by consumers.

The disclosure of U.S. patent application Ser. No. 11/950,547, filed Dec. 5, 2007, is incorporated herein by reference. For example, the tips disclosed in that application can be used with any of the embodiments disclosed in this application. For example, tip 1500 could be packaged for sale with the embodiment in FIG. 11 disclosed in this application (either attached to one of the ends—17 or 16—or located adjacent to inner shell and pre-rolled sheet 10). Additionally, the various embodiments of the inner shell and pre-rolled sheet disclosed in this application can replaced the various packaged tobacco products in FIGS. 19 through 27 of the incorporated by reference disclosure. For example, one of the embodiments for the inner shell and pre-rolled sheet can be substituted for item 850 in FIG. 19, item 800 in FIGS. 20 and 21, item 810 in FIGS. 22 and 23, item 800 in FIGS. 24 and 25, and item 400 in FIGS. 26 and 27.

REFERENCE NUMERAL LIST

| REFERENCE NO. | DESCRIPTION |
|---|---|
| 10 | inner shell and pre-rolled sheet |
| 15 | inner shell |
| 16 | first end |
| 17 | second end |
| 20 | tobacco filler material |
| 22 | tobacco filler material |
| 24 | tobacco filler material |
| 26 | container |
| 30 | outer wall of inner shell |
| 35 | volume |
| 50 | perforated line |
| 51 | edge |
| 52 | edge |
| 60 | line |
| 70 | serrated perforations |
| 80 | box |
| 90 | wrapper |
| 95 | flap |
| 100 | inner shell |
| 101 | outer wall |
| 102 | perforated line |
| 103 | edge |
| 104 | edge |
| 106 | plurality of openings |
| 108 | interior volume |
| 110 | pre-rolled sheet |
| 111 | edge |
| 112 | edge |
| 113 | edge |
| 114 | edge |
| 115 | corner |
| 116 | upper surface |
| 118 | adhesive |
| 120 | bore |
| 122 | angle |
| 150 | arrow |
| 160 | wrapper |
| 162 | first end |
| 164 | second end |
| 170 | pouch |
| 180 | flap (which can include a re-usable seal such as Zip-lock type seal) |
| 182 | notch |
| 190 | carton |
| 192 | lid |
| 200 | indicia |
| 240 | sheet |
| 241 | edge |
| 242 | edge |
| 245 | openings |
| 246 | openings |
| 247 | arrow |
| 248 | arrow |
| 250 | cord/string/thread/tie |
| 260 | sheet |
| 261 | edge |
| 262 | edge |
| 270 | area |
| 271 | edge |
| 272 | edge |
| 300 | arrow |
| 302 | arrows |
| 310 | arrow |
| 311 | arrow |
| 312 | arrows |
| 314 | arrow |
| 320 | arrow |
| 322 | arrows |
| 332 | arrows |
| 340 | arrow |
| 342 | arrow |

-continued

REFERENCE NUMERAL LIST

| REFERENCE NO. | DESCRIPTION |
|---|---|
| 344 | arrow |
| 400 | user's hand or finger or thumb |
| 402 | user's hand or finger or thumb |
| 404 | user |
| 500 | non-smokable casing or form mandrel |
| 510 | inner casing or form mandrel |
| 520 | scented, flavored, and/or moisture filled material |
| 530 | plurality migration waves |

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A tobacco product comprising: (a) an inner shell, the inner shell having an outer wall, first and second ends, and a longitudinal volume, the volume being at least partially filled with an initial tobacco filler material; (b) a plurality of perforations which can be opened to access the volume, and after being opened causing the inner shell to have first and second longitudinal edge portions which can be moved apart; (c) an outer rolled sheet rolled about the inner shell, the outer rolled sheet having peripheral edge portions, at least a part of one of said peripheral edge portions being diagonally attached to the inner shell so that the peripheral edge portion of the outer rolled sheet spirally wraps about the inner shell; (d) wherein the rolled outer sheet and inner shell are packaged for sale in packaging in a rolled condition; and (e) wherein, after the outer sheet and inner shell are removed from the packaging, the rolled outer sheet can be unrolled from the inner shell first revealing the plurality of perforations, the perforations can be opened and the first and second edge portions can be moved apart thereby allowing a consumer to remove at least part of the initial tobacco filler from the inner volume, and add new tobacco filler material to the longitudinal volume; (f) wherein the first and second end portions can be moved together to close the inner shell on the new tobacco filler material, and the outer sheet can be re-rolled about the inner shell forming a custom cigar; wherein the plurality of perforations are small enough so that air flow through the perforations is minimized, but large enough to allow a consumer to separate the perforations; wherein the inner shell also includes a plurality of openings for migration of moisture and flavoring between the longitudinal volume and outer shell, which plurality of openings are hidden by the outer shell when the outer sheet is wrapped about the inner shell.

2. The tobacco product of claim 1, wherein the plurality of perforations are in a straight line across the longitudinal length of the inner shell.

3. The tobacco product of claim 1, wherein the inner shell and rolled outer pre-rolled sheet are packaged for sale as a single cigar.

4. The tobacco product of claim 1, wherein the inner shell and rolled outer pre-rolled sheet are packaged for sale in a multiple cigar zip-wrapper packaging.

5. The tobacco product of claim 1, wherein the rolled outer pre-rolled sheet is spirally wrapped about the inner shell.

6. The tobacco product of claim 1, wherein the rolled outer pre-rolled sheet is wrapped about the inner shell in a transverse direction.

7. The tobacco product of claim 1, wherein the rolled outer pre-rolled sheet is attached to the inner shell with an adhesive.

8. A tobacco product comprising:

(a) an inner shell, the inner shell having an outer wall, first and second ends, and a longitudinally extending interior void space, the void space being at least partially filled with an initial tobacco filler material;

(b) a plurality of perforations which can be opened to access the volume, and after being opened causing the inner shell to have first and second longitudinal edge portions which can be moved apart;

(c) an outer rolled sheet that has multiple outer sheet corners, wherein one said outer sheet corner is attached to the inner shell at an attachment, the other outer sheet corners being not attached to the inner shell and spaced away from said attachment;

(d) wherein the rolled outer sheet and inner shell are packaged for sale in packaging in a rolled condition; and (e) wherein, after the outer sheet and inner shell are removed from the packaging, the rolled outer sheet can be unrolled from the inner shell first revealing the plurality of perforations, the perforations can be opened and the first and second edge portions can be moved apart thereby allowing a consumer to remove at least part of the initial tobacco filler from the void space, and add new smokable filler material to the void space;

(f) wherein the first and second end portions can be moved together to close the inner shell on the new smokable filler material, and the outer sheet can be re-rolled about the inner shell forming a custom cigar;

(g) wherein the plurality of perforations are small enough so that air flow through the perforations is minimized, but large enough to allow a consumer to separate the perforations; wherein the inner shell also includes a plurality of openings for migration of moisture and flavoring between the longitudinal volume and outer shell, which plurality of openings are hidden by the outer shell when the outer sheet is wrapped about the inner shell.

9. The tobacco product of claim 8, wherein the plurality of perforations are in a straight line across the longitudinal length of the inner shell.

10. The tobacco product of claim 8, wherein the inner shell and rolled outer pre-rolled sheet are packaged for sale as a single cigar.

11. The tobacco product of claim 8, wherein the inner shell and rolled outer pre-rolled sheet are packaged for sale in a multiple cigar wrapper packaging.

12. The tobacco product of claim 8, wherein the rolled outer pre-rolled sheet is spirally wrapped about the inner shell.

13. The tobacco product of claim 8, wherein the rolled outer pre-rolled sheet is wrapped about the inner shell in a transverse direction.

14. The tobacco product of claim 8, wherein the rolled outer pre-rolled sheet is attached to the inner shell with an adhesive.

15. A tobacco product comprising:

(a) an inner shell, the inner shell having an outer wall, first and second ends, and a longitudinal bore with a central longitudinal bore axis, the bore being at least partially filled with an initial tobacco filler material;

(b) a plurality of perforations which can be opened to access the bore, and after being opened causing the inner shell to have first and second longitudinal edge portions which can be moved apart;

(c) an outer rolled sheet that is rolled around the inner shell, said sheet having one or more edges that spirally track around the inner shell, a part of said outer sheet but not all of said outer sheet being attached to said inner shell so that one or more of said edges are obliquely positioned relative to the bore axis;

(d) wherein the rolled outer sheet and inner shell are packaged for sale in packaging in a rolled condition;

(e) wherein, after the outer sheet and inner shell are removed from the packaging, the rolled outer sheet can be unrolled from the inner shell first revealing the plurality of perforations, the perforations can be opened and the first and second edge portions can be moved apart thereby allowing a consumer to remove at least part of the initial tobacco filler from the bore, and add new smokable filler material to the bore; and (f) wherein the first and second end portions can be moved together to close the inner shell on the new smokable filler material, and the outer sheet can be re-rolled about the inner shell forming a custom cigar.

16. The tobacco product of claim 15, wherein the plurality of perforations are in a straight line across the longitudinal length of the inner shell.

17. The tobacco product of claim 15, wherein the inner shell and rolled outer pre-rolled sheet are packaged for sale as a single cigar.

18. The tobacco product of claim 15, wherein the inner shell and rolled outer pre-rolled sheet are packaged for sale in a multiple cigar wrapper packaging.

19. The tobacco product of claim 15, wherein the rolled outer pre-rolled sheet is spirally wrapped about the inner shell.

20. The tobacco product of claim 15, wherein the rolled outer pre-rolled sheet is wrapped about the inner shell in a transverse direction.

21. The tobacco product of claim 15 wherein the rolled outer pre-rolled sheet is attached to the inner shell with an adhesive.

* * * * *